US005573341A

United States Patent [19]

Iaia

[11] Patent Number: 5,573,341

[45] Date of Patent: Nov. 12, 1996

[54] COSMETIC COMPOSITION DISPENSER

[75] Inventor: Mark Iaia, West Nyack, N.Y.

[73] Assignee: Chesebrough-Pond's USA Co., Division of Conopco, Inc., Greenwich, Conn.

[21] Appl. No.: 329,569

[22] Filed: Oct. 26, 1994

[51] Int. Cl.[6] ..... A45D 40/06; A45D 40/04

[52] U.S. Cl. ..... 401/172; 401/66; 401/175; 401/179; 401/181; 401/194

[58] Field of Search ..... 401/171, 172, 401/175, 179, 181, 66, 266, 194

[56] References Cited

U.S. PATENT DOCUMENTS

| | | | |
|---|---|---|---|
| D. 331,534 | 12/1992 | Thompson et al. . | |
| D. 331,639 | 12/1992 | Thompson . | |
| 1,950,324 | 3/1934 | Powers | 401/175 X |
| 2,080,343 | 5/1937 | Smith . | |
| 2,335,049 | 11/1943 | Finkelstein . | |
| 3,104,031 | 9/1963 | Wagner . | |
| 3,749,871 | 7/1973 | Stoll et al. | 200/156 |
| 4,595,124 | 6/1986 | Duval et al. . | |
| 4,865,231 | 9/1989 | Wiercinski . | |
| 5,000,356 | 3/1991 | Johnson et al. . | |
| 5,007,755 | 4/1991 | Thompson . | |
| 5,111,972 | 5/1992 | Sakurai et al. . | |

FOREIGN PATENT DOCUMENTS

| | | |
|---|---|---|
| 403240678A | 2/1990 | Japan . |
| 261014 | 10/1944 | Switzerland . |
| 281384 | 8/1949 | Switzerland . |

*Primary Examiner*—Steven A. Bratlie
*Attorney, Agent, or Firm*—Milton L. Honig

[57] ABSTRACT

A dispenser is provided that includes a container for storing a dispensable chemical product such as an underarm composition, an elevator mounted for axial movement within the container, a rotatable shaft attached to the elevator, a housing below the elevator and a mechanism for axially advancing the elevator within the container. The advancement mechanism includes a ratchet wheel with a plurality of teeth circumferentially surrounding the wheel and a mechanism to rotate the ratchet wheel which includes a flexible arm attached to the housing and having a pawl for moving the teeth of the ratchet wheel.

12 Claims, 4 Drawing Sheets

COSMETIC COMPOSITION DISPENSER

BACKGROUND OF THE INVENTION

1. Field of the Invention

The invention concerns a dispenser for solid or semi-solid compositions, particularly underarm cosmetics, which are delivered in a metered quantity from a chamber by manual rotation of a screwdrive elevating a piston contacting the compositions.

2. The Related Art

Underarm cosmetics such as antiperspirants and deodorants have been delivered in three distinct formats. Application has been either through aerosol sprays, roll-on ball applicators and propel-repel piston operated sticks. Commercially most popular have been the stick variety. More recently, a fourth underarm product format has entered the marketplace, namely semi-solids. Packaging for the semi-solids has proved quite challenging.

An early entry into the semi-solid product form was Arrid® Extra Dry Glide-On distributed by the Carter-Wallace Company. Packaging of this product is similar to that utilized for traditional sticks. An oval container with a knurled screw propel-repel mechanism is employed to control a screw-type piston. The new aspect is a plastic dome around the upper end of the container, with a series of apertures in the plastic dome for exit of the semi-solid product.

More recently the Gillette® Series products entered the marketplace. Besides a transparent package and clear product, Gillette® innovated with refinement of the product dispensing apertures. U.S. Pat. No. 5,007,755 (Thompson), assigned to the Gillette Company, describes a domed or application surface structure having an array of dispensing ports located at an outlet end of respective elongated distribution passages. These passages are further defined by an interconnected array of elongated divider webs shaped to provide each of the passages with a flared entrance port and a relieved dispensing port region at the application surface. Metered quantities of gel cosmetic material are reported achievable as a result of this array of flared entrance ports, interconnected divider webs, distribution passages and dispensing ports. See also the related design cases: U.S. Pat. No. Des. 331,534 and U.S. Pat. No. Des. 331,639.

On the heels of these developments, the Procter & Gamble Company launched its version of a semi-solid underarm product known as Secret® Ultra Dry. U.S. Pat. 5,000,356 (Johnson et al.) describes the Secret® Ultra Dry package as a swivel-up type dispensing container using a feed screw to drive an elevator which impels the cream product in a unidirectional manner. The drive of the feed screw is superimposed with reciprocatory motion caused by internal cams which retract the elevator. By intermittently retracting the elevator a suitable distance, discrete amounts of the product are dispensed for each cycle. Residual pressure on the product is thereby also relieved which prevents it from weeping onto the applicator surface of the dispenser.

Related technology is disclosed in U.S. Pat. No. 4,865,231 (Wiercinski). This swivel-up type dispensing package includes a button adapted to be depressed by the user in a direction which is generally transverse to the axis of the body of the dispensing package. Transverse movement of the button is converted to rotary input to either a feed screw or nut to cause one to rotate relative to the other and thereby move an elevator for the product. The button has an integral pawl which during transverse movement engages ratchet teeth fixed to a wheel mounted perpendicularly to the axis of the body, causing the wheel to rotate through an arc subtended by driven teeth.

Japanese Patent Publication 3-240678 (A) reports a liquid discharging device that includes a mechanism to quantify discharge by using a click or collision sound at a time when ratchet teeth are mutually brought near an elastic member.

U.S. Pat. No. 5,111,972 (Sakurai et al.) describes a multi-compartment dispenser for delivering a plurality of different creamy substances. The dispenser includes a tubular case with two chambers containing the creamy substances, a tubular member disposed within each chamber for axial movement, a hollow cylinder rotatably fitted over each tubular member and having longitudinal teeth on its outer surface, an extrusion plunger fitted into each chamber for axial movement which includes a plate member, a tubular boss projecting downwardly from the plate member, and an operating member capable of simultaneously rotating the two hollow cylinders. The operating member is moved to turn the hollow cylinders by a predetermined angle so that the extrusion plungers are raised simultaneously a predetermined distance thereby extruding the creamy substances.

From the foregoing description of the related art, it is evident there have been some significant advances in the packaging of semi-solid products. Yet, a number of further challenges remain. Some of the aforementioned packaging involves complicated mechanisms that are relatively expensive to manufacture. Certain of the packages require two-handed operation which renders them somewhat inconvenient during the dispensing operation along the underarms. Others of the aforementioned devices do not provide the user with a proper indication of the amount of product metered.

Accordingly, it is an object of the present invention to provide a dispenser for solids or semi-solids that provides a user with finer control in metering doses from the dispenser.

Another object of the present invention is to provide a dispenser for solids or semi-solids that includes a mechanism with an audible click allowing a user to dispense identical dosages repetitively and accurately.

Yet another object of the present invention is to provide a dispenser for solids or semi-solids that does not require two-handed operation during dispensing of product, especially in the underarm area of a human body.

These and other objects of the present invention will become more readily apparent through consideration of the following summary and description.

SUMMARY OF THE INVENTION

A dispenser is provided that includes:

a container for storing a dispensable chemical product, the container having a dispensing end and a closed end which are opposite one another and located along a longitudinal axis traversing a length of the container;

an elevator having a cross-section congruent to an internal cross-section of the container and mounted for axial movement within the container;

a rotatable shaft attached to the elevator for imparting upward movement thereto, the shaft being parallel to the longitudinal axis of the container;

a housing located below the elevator at the closed end of the container; and a mechanism for axially advancing the elevator within the container, the mechanism being received within the housing and including:

a ratchet wheel with a plurality of teeth circumferentially surrounding the wheel, the wheel being orthogonally oriented and attached to an end of the shaft;

a mechanism to rotate the ratchet wheel including a flexible arm unitarily formed as a single plastic element comprising a central area as a button and left and right wings flanking the central area, at least one of the wings being curved, and acting as a spring returning the button from an inwardly to an outwardly position; and a pawl engagable with teeth of the ratchet wheel, the pawl being connected to the flexible arm.

In a preferred embodiment, the pawl is curved with a free end closest to the ratchet wheel being engagable with that wheel.

Preferably a central area of the flexible arm projects outwardly through a window in an outer wall of the housing. The central area forms a button which when pressed by a user operates engagement of the pawl with the ratchet wheel. Within the housing may also be present a post oriented parallel to the shaft. The movable arm can then be anchored to this post, preferably through a collar that surrounds the post and is unitarily formed with the arm. The post may have a length shorter in size than a width of the flexible arm.

The flexible arm can include left and right wings flanking the central area, all of which are unitarily formed together as a single plastic element.

Furthermore, the housing may include a left and right recess respectively flanking the window, for receipt of a respective wing. Especially useful is where one of the wings is curved thereby introducing a spring action through the flexibility and single point of contact of the wing against the wall of the recess.

There may also be present a mechanism to generate an audible click upon movement of the ratchet wheel. This clicking mechanism may include a flexible plastic clicking pawl with first and second ends, the first end being attached to the flexible arm and the second end displaceably contacting a tooth of the ratchet wheel. The flexible plastic pawl suitable for clicking is preferably curved. A first end of the pawl may be anchored to the housing via the post.

In another aspect of the invention, the container is oval in shape while the elevator includes an oval crown surrounded by an oval skirt. The skirt is formed from a flexible plastic, concave in shape and contacting an inner wall of the container only along respective upper and lower margins of the skirt.

BRIEF DESCRIPTION OF THE DRAWING

The above features, advantages and objects of the present invention will more fully be appreciated through the following detailed discussion, reference being made to the drawings consisting of.

DETAILED DESCRIPTION OF THE INVENTION

Figure 1:
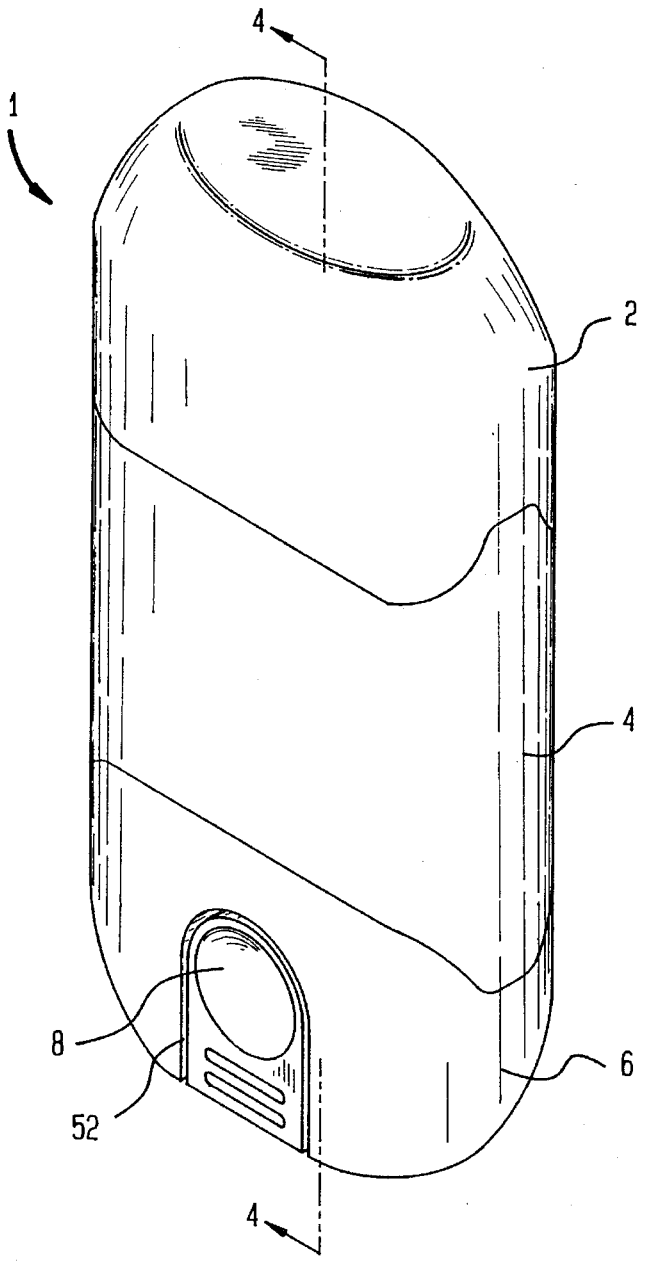
FIG. 1 which is a front perspective view of the dispenser according to the present invention.
Figure 2:
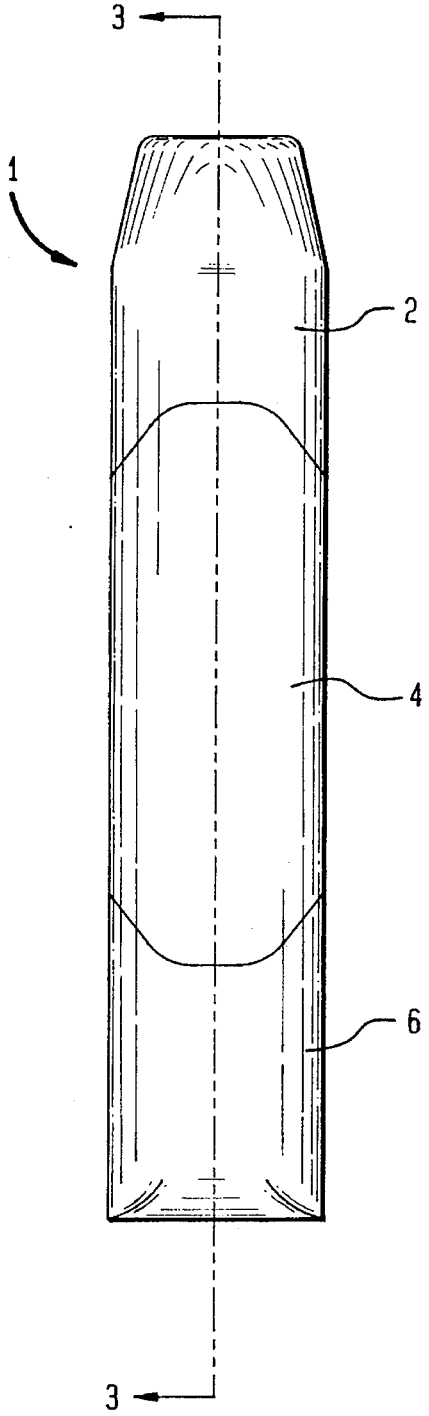
FIG. 2 which is a side elevational view of the dispenser as shown in FIG. 1.

According to the present invention, the most preferred embodiment is dispenser 1 whose external views are shown in FIGS. 1 and 2. Dispenser 1 includes a cap 2 to prevent dryout, a container 4 for storage of a dispensable chemical product, a housing 6 for containing a mechanism to cause dispensing of the chemical product and a button 8 which a user presses to activate the dispensing mechanism.

Figure 3:
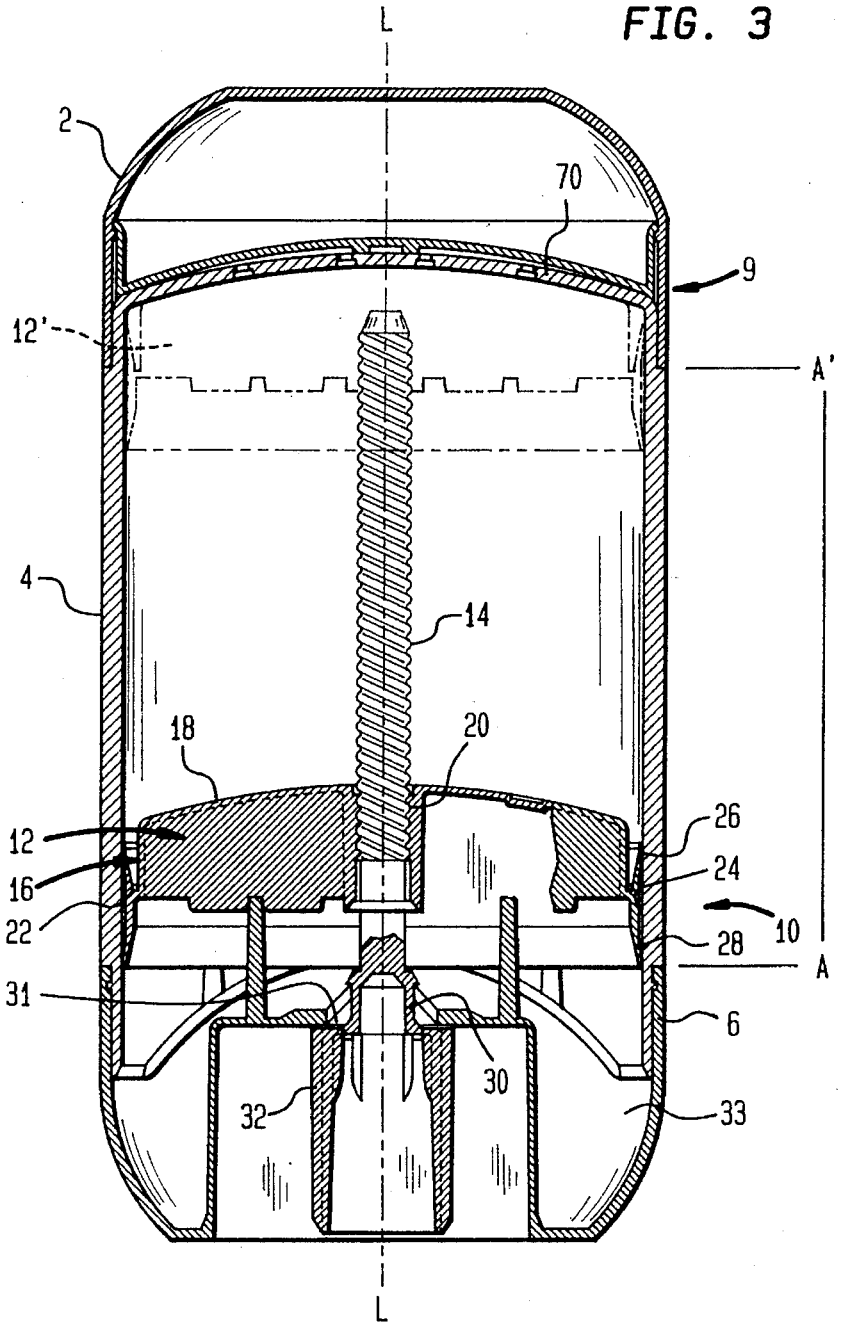
FIG. 3 which is a cross-sectional view of the dispenser taken along lines 3—3 of FIG. 2.
Figure 4:
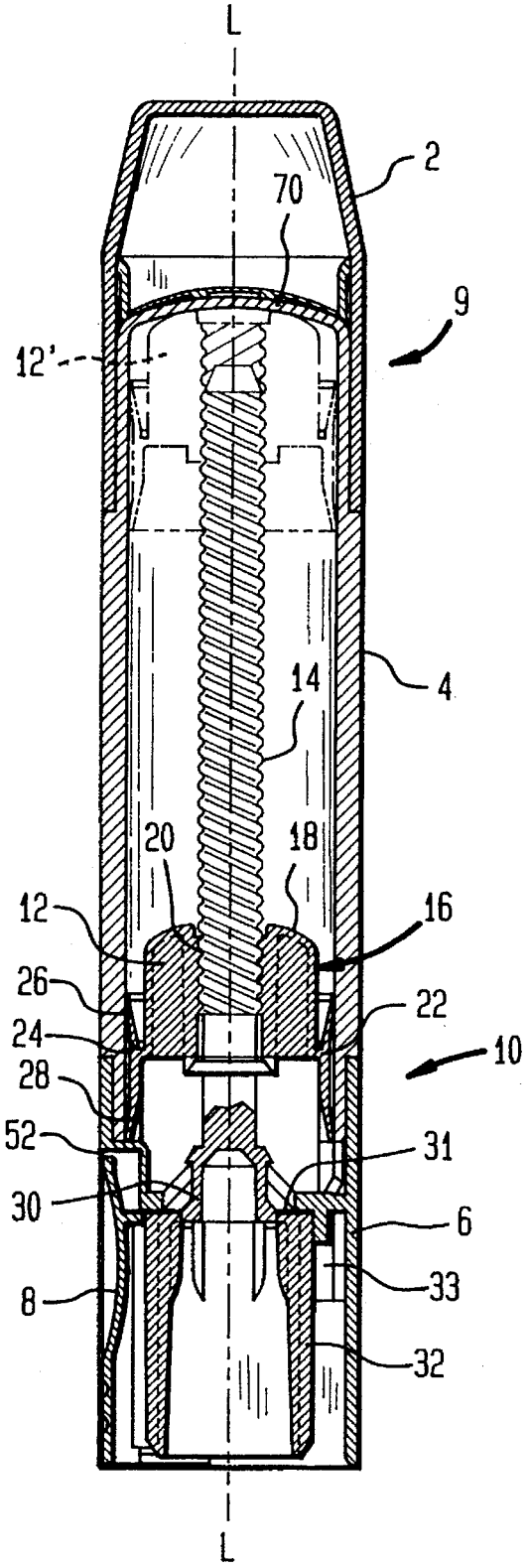
FIG. 4 which is a cross-sectional view of the dispenser taken along line 4—4 of FIG. 1.

FIGS. 3 and 4 are cross-sectional views of the dispenser illustrating various functional elements held within dispenser 1. Container 4 is formed with a dispensing end 9 and a closed end 10 opposite one another and located along a longitudinal axis L traversing a length of the container. An elevator 12 is mounted for axial movement within container 4. The elevator 12 has a cross-section congruent to an internal cross-section of the container 4. Upward or downward movement of elevator 12 is directed by the rotation of a rotatable shaft 14, the shaft being parallel to longitudinal axis L of container 4.

Elevator 12 includes a crown 16, having an upper surface 18 in contact with the dispensable chemical product. At the center of the crown is a round female threaded aperture 20 through which rotatable shaft 14 extends and can engage for threadable movement. Crown 16 is surrounded by a skid 22 formed of a flexible plastic. Skirt 22 is concave in shape. As a result, skid 22 sealingly contacts an inner wall 24 of container 4 only along an upper and a lower margin 26, 28 of the skirt.

When all the chemical product contained within the container has been spent, elevator 12 will have moved from position A to position A'. In FIGS. 3 and 4, the elevator 12' is shown in phantom to illustrate the fully dispensed position of A'. As seen from the drawings, the most preferred geometry for the dispenser, and therefore of necessity for the container, cap, housing and elevator with crown and skid, is an oval shape.

Figure 5:
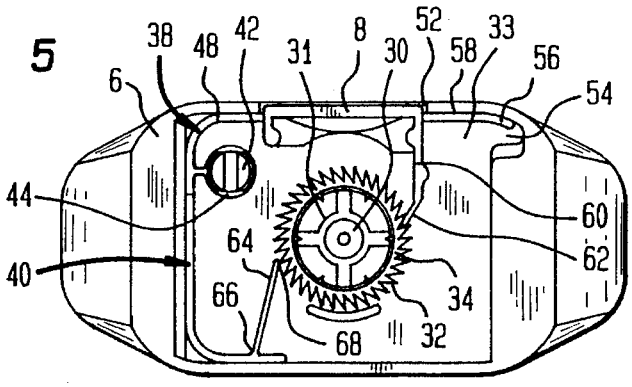
FIG. 5 which is a bottom plan view of the dispenser according to FIG. 1.
Figure 6:
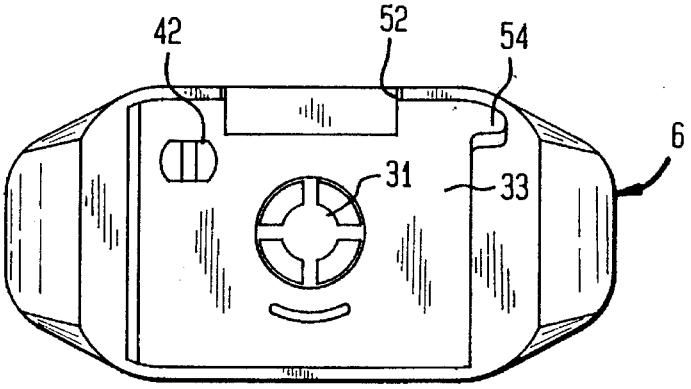
FIG. 6 which is identical to FIG. 5, except that the movable arm with pawls for rotating the ratchet wheel and for generating an audible click have been removed.
Figure 7:
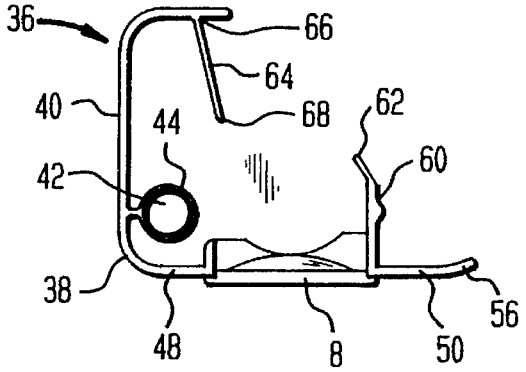
FIG. 7 which is the unitarily molded movable arm present in FIG. 5 and removed from FIG. 6.

Rotatable shaft 14 at its lower terminus ends in a coupling element 30 held within housing 6. An aperture 31 within housing 6 opens to permit coupling element 30 to pass therethrough into an interior area 33 of the housing. A ratchet wheel 32 is rigidly attached to coupling element 30. This aspect of the invention is best seen in FIGS. 5–7. Ratchet wheel 32 is provided with a plurality of teeth 34 circumferentially surrounding the wheel, the latter being orthogonally oriented to the shaft.

Supported within interior area 33 of the housing is a flexible arm 36. This arm is fashioned with a first and second portion 38, 40 unitarily formed from a single plastic strip. Flexible arm 36 is secured within the housing to post 42, the latter oriented downward and parallel to the rotatable shaft. A collar 44, integrally molded with flexible arm 36, tightly surrounds post 42 thereby achieving the aforementioned anchor of arm to housing.

The first portion 38 of the flexible arm consists of a central area forming the button 8 flanked by left and right wings 48, 50. Button 8 is positioned within window 52 formed in housing 6. Within the interior area 33 of the housing is a recess 54 receiving an end section 56 of right wing 50. Right wing 50 is gently curved to serve as a spring and to support flexible arm 36 so that button 8 is properly aligned within window 52. Wall 58 of recess 54 serves as a stop for the spring action of right wing 50 and also helps maintain proper orientation of button 8 within window 52.

A pawl 60 protrudes inwardly from flexible arm 36 and is unitarily attached to the arm along first portion 38. A free end 62 of the pawl closest to the ratchet wheel engages teeth of that wheel.

A clicking mechanism is provided in the form of a flexible plastic clicking pawl 64 with first and second ends 66, 68. The first end 66 is attached to the second portion 40 of the flexible arm. Second end 68 displaceably contacts the teeth of ratchet wheel 32.

Figure 8:
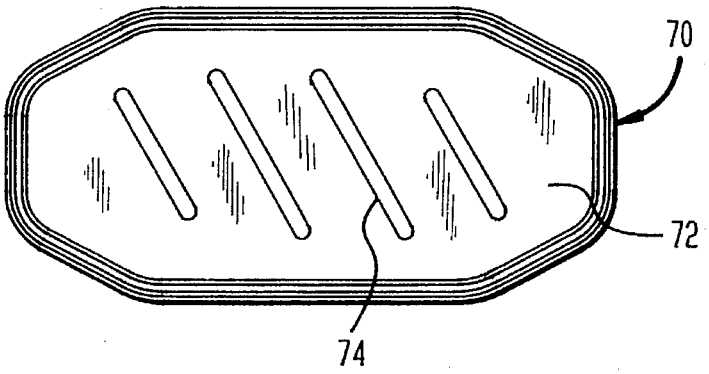
FIG. 8 which is a top plan view of the dispenser with cap removed.

FIG. 8 illustrates cover 70 which fits over container 4 at the dispensing end 9. Top surface 72 of cover 70 is formed with four slots 74 which permit passage of the dispensable chemical product from the container onto an application surface (e.g. a human underarm).

Dispenser 1 is operated by a user pressing button 8. In turn, button 8 moves pawl 60 inward which causes ratchet wheel 32 to rotate one tooth distance. Simultaneously, clicking pawl 64 will be forced to move one tooth along its sector of the ratchet wheel generating an audible clicking sound. As the ratchet wheel 32 turns, shaft 14 is rotated which results in elevator 12 moving upward by interaction of threads on the shaft advancing within the female threaded aperture 20 of crown 16. Chemical product is thereby expressed through slots 74 of cover 70. All of the aforementioned procedures can be rapidly repeated through further pressure against button 8.

The foregoing description illustrates only a selected embodiment of the present invention. In light thereof, various modifications will be suggested to one skilled in the art, all of which are within the spirit and purview of this invention.

What is claimed is:

1. A dispenser comprising:

a container for storing a dispensable chemical product, the container having a dispensing end and a closed end which are opposite one another and located along a longitudinal axis traversing a length of the container;

an elevator having a cross-section congruent to an internal cross-section of the container and mounted for axial movement within the container;

a rotatable shaft attached to the elevator for imparting upward movement thereto, the shaft being parallel to the longitudinal axis of the container;

a housing located below the elevator at the closed end of the container; and a means for axially advancing the elevator within the container, the means being received within the housing and including:

a ratchet wheel with a plurality of teeth circumferentially surrounding the wheel, the wheel being orthogonally oriented and attached to an end of the shaft;

a means to rotate the ratchet wheel including a flexible arm unitarily formed as a single plastic element comprising a central area as a button and left and right wings flanking the central area, at least one of the wings being curved and the arm acting as a spring returning the button from an inwardly to an outwardly position; and a pawl engagable with teeth of the ratchet wheel, the pawl being connected to the flexible arm.

2. A dispenser according to claim 1 wherein the pawl is curved.

3. A dispenser according to claim 1 wherein a window is formed in an outer wall of the housing and the central area of the flexible arm is aligned within the window.

4. A dispenser according to claim 1 further comprising a post oriented downward in a direction opposite the dispensing end and parallel to the rotatable shaft, the post being arranged within the housing and the movable arm being anchored to the post.

5. A dispenser according to claim 4 wherein the flexible arm includes a collar that surrounds the post thereby anchoring the arm to the post.

6. A dispenser according to claim 1 wherein the flexible arm comprises a first and second portion, the first portion including the central area and the left and right wings flanking the central area.

7. A dispenser according to claim 6 wherein the right wing is curved.

8. A dispenser according to claim 7 wherein the housing further comprises a window formed in an outer wall of the housing and an interior area within which is a recess that flanks the window.

9. A dispenser according to claim 8 wherein the right wing is received within the recess.

10. A dispenser according to claim 1 further comprising a means to generate an audible click upon movement of the ratchet wheel, the means comprising a flexible plastic clicking pawl with first and second ends, the first end being attached to the flexible arm and the second end displaceably contacting a tooth of the ratchet wheel.

11. A dispenser according to claim 1 wherein the container is oval in shape and the elevator includes an oval crown surrounded by an oval skirt, the skirt being formed from a flexible plastic, concave in shape and contacting an inner wall of the container only along an upper and a lower margin of the skirt.

12. A dispenser according to claim 10 wherein the flexible plastic clicking pawl is arranged to have its second end pointing toward the button.

* * * * *